US006625872B1

(12) United States Patent
Mihara et al.

(10) Patent No.: US 6,625,872 B1
(45) Date of Patent: Sep. 30, 2003

(54) METHOD FOR SINTERING MAGNETIC CORE

(75) Inventors: Hideyuki Mihara, Shiga-ken (JP); Hiroyuki Kino, Shiga-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/471,545

(22) Filed: Dec. 23, 1999

(30) Foreign Application Priority Data

Jan. 6, 1999 (JP) ..... 11-000934

(51) Int. Cl.[7] ..... H01F 7/06

(52) U.S. Cl. ..... 29/607; 29/603.2; 29/604; 29/606; 29/737; 310/156; 310/254; 310/258; 310/259; 419/10; 419/29; 419/30; 419/35; 419/49

(58) Field of Search ..... 29/603.2, 604, 29/607, 737, 606, 525; 310/156, 254, 258, 259, 261, 264; 419/10, 29, 30, 35, 49

(56) References Cited

U.S. PATENT DOCUMENTS 3,721,612 A * 3/1973 Gigoux ..... 204/15
3,772,755 A * 11/1973 Draving ..... 29/203
3,792,527 A * 2/1974 Krag ..... 29/604
5,352,522 A * 10/1994 Kugimiya ..... 428/403
5,935,722 A * 8/1999 Moorhead ..... 428/694
5,977,854 A * 11/1999 Mihara ..... 336/92
5,982,073 A * 11/1999 Lashmore ..... 310/254
6,006,418 A * 12/1999 Takeda ..... 29/598
6,054,649 A * 4/2000 Uchida ..... 174/36

FOREIGN PATENT DOCUMENTS

JP 1-112716 5/1989
JP 1-176277 7/1989
JP 05055047 A * 3/1993
JP 05166633 A * 7/1993
JP 05283237 A * 10/1993

* cited by examiner

*Primary Examiner*—A. Dexter Tugbang
*Assistant Examiner*—Paul Kim
(74) *Attorney, Agent, or Firm*—Keating & Bennett, LLP

(57) ABSTRACT

A method for easily sintering a magnetic core while preventing damage to the magnetic core caused by deformation or other problems, includes preparing a flattened tubular compact by forming the compact to have a flattened tubular shape and a through hole. A supporting plate made from a baked porcelain material or a metal material having a dimension that allows for insertion into the through hole of the flattened tubular compact, as well as a length that is sufficiently longer than that of the flattened tubular compact, is inserted through the through hole. The flattened tubular compact is placed inside of a sintering container having highly pure alumina powder spread therein so that the axial direction of the compact is horizontal. The flattened tubular compact is then sintered in a sintering furnace to produce the magnetic core.

20 Claims, 4 Drawing Sheets

METHOD FOR SINTERING MAGNETIC CORE

BACKGROUND OF THE INVENTION

1. Field of the Invention

The present invention relates to a method for sintering a magnetic core, and more specifically relates to a method for sintering a flattened tubular magnetic core which is for use as a noise suppressing component.

2. Description of the Related Art

A conventional noise suppressing component includes a flattened tubular magnetic core as shown in FIG. 10. High frequency noise propagating in a signal line is suppressed by the magnetic core 21 in an arrangement in which a signal line, such as a flat cable, is inserted through a slot-like through hole 22. Cores having a longer side dimension L of 10 mm to 100 mm and a shorter side dimension T of 1 mm to 10 mm, and a through hole 22 having shorter side dimension t of 0.3 mm to 8 mm in lateral cross-section are used commonly as the magnetic core 21. Conventional methods for sintering such a magnetic core 21 are shown in FIG. 11 and FIG. 12.

That is, the sintering method shown in FIG. 11 is a method of sintering flattened tubular compacts 21 having a through hole 22, made of a ferrite material, while the flattened tubular compacts 21 are upright on the opening surface of one end in a sintering container (not illustrated) such that an axial direction of the compact 21 is vertical. Furthermore, the sintering method shown in FIG. 12 is a sintering method with flattened tubular compacts 21 arranged in a sintering container (not shown) such that the axial direction thereof is horizontal.

However, conventional sintering methods for magnetic cores cause problems in that since amounts of friction are large at the contacting surfaces of the flattened tubular compacts 21 and the sintering container, the flattened tubular compacts after sintering (that is, the magnetic cores) 21 can be severely deformed. Moreover, chemical reactions with the sintering container can easily occur so that discoloration or chipping due to adhesion to the sintering container may occur. In order to prevent this from occurring, the flattened tubular compacts 21 are sometimes sintered on highly pure alumina powder or zirconia powder spread in the sintering containers.

However, when the flattened tubular compacts 21 are sintered while upright in the sintering container as shown in FIG. 11, a problem arises in that the flattened tubular compacts 21 may become tilted and deformed, or adjacent flattened tubular compacts 21 may come into contact with each other, generating reactions, adhesion, or chipping due to small vibrations or shocks during transport.

In contrast, when the flattened tubular compacts 21 are baked while being arranged on their sides in the sintering container with the axial directions thereof disposed horizontally, as shown in FIG. 12, the problems of skewing or contact generated when the flattened tubular compacts 21 are sintered upright can be solved. However, when the flattened tubular compacts 21 soften during sintering, the side wall portions at the upper sides of the laterally oriented compacts 21 may sag toward the through hole 22 side. Therefore, another problem arises in that the shorter side dimension t of the through hole 22 of the flattened tubular compacts after sintering (the magnetic cores) 21 may be less than the desired value.

SUMMARY OF THE INVENTION

In order to solve the problems with conventional methods as described above, preferred embodiments of the present invention provide a method for easily sintering a magnetic core easily while preventing damage to the core caused by sagging or deformation.

According to one preferred embodiment of the present invention, a method for sintering a magnetic core includes the steps of providing a flattened tubular compact made from a magnetic material and having a through hole, providing a supporting plate which is constructed to maintain its shape at a sintering temperature of the flattened tubular compact, inserting the supporting plate through the through hole of the flattened tubular compact, and sintering the flattened tubular compact while the supporting plate is located in the through hole of the flattened tubular compact.

The supporting plate may be made of, for example, a sintered ceramic material or a metal material.

Since the flattened tubular compact is sintered with the supporting plate inserted through the through hole thereof, even when the flattened tubular compact softens during sintering, producing the possibility of "sagging", the shorter side dimension of the through hole of the magnetic core is not be less than the thickness dimension of the supporting plate.

Furthermore, since the supporting plate is preferably tapered in the direction of insertion into the through hole of the flattened tubular compact, the operation of removing the supporting plate from the flattened tubular compact after sintering (the magnetic core) is greatly facilitated.

Other features, steps, advantages and aspects of the present invention will be evident from the detailed description of preferred embodiments with reference to the attached drawings.

DETAILED DESCRIPTION OF PREFERRED EMBODIMENTS

Hereinafter, preferred embodiments of a sintering method for a magnetic core according to the present invention will be explained with reference to the accompanying drawings.

Figure 1:
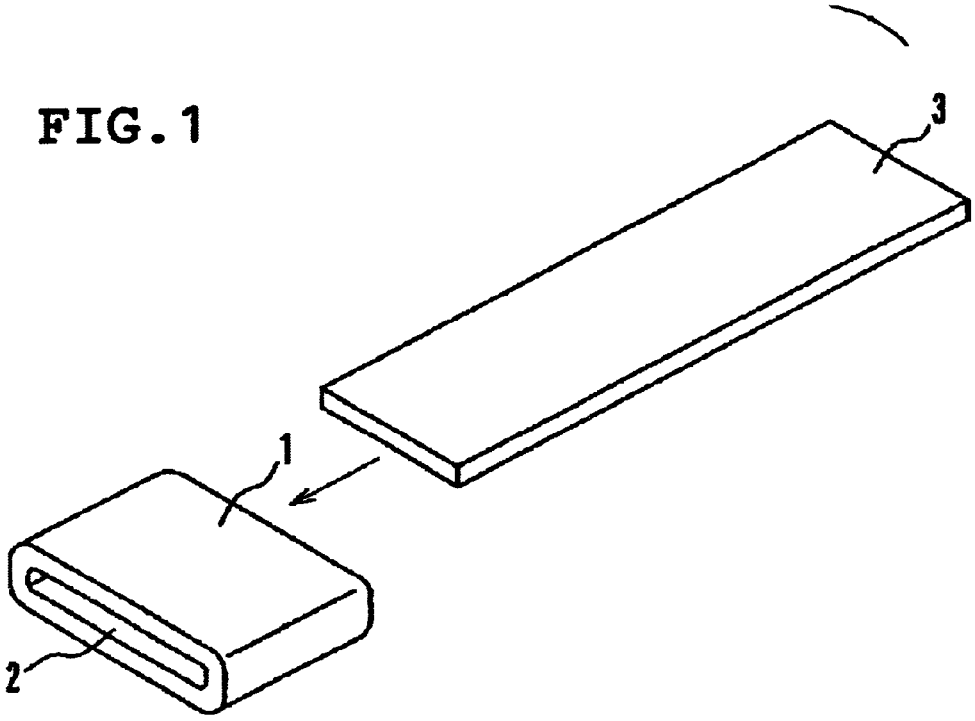
FIG. 1 is a perspective view showing a preferred embodiment of a method for sintering a magnetic core according to the present invention.
Figure 2:
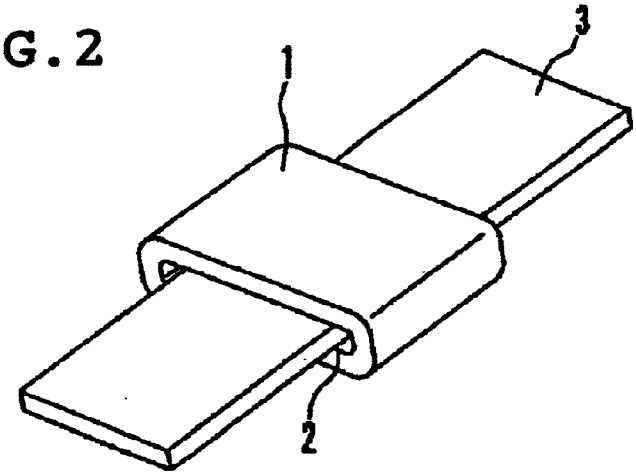
FIG. 2 is a perspective view showing the step subsequent to the step shown in FIG. 1.

A preferred embodiment of a sintering method for a magnetic core according to the present invention is shown in FIGS. 1 and 2. As shown in FIG. 1, a flattened tubular compact 1 and a supporting plate 3 therefor are prepared. The flattened tubular compact 1 preferably having a flattened tubular shape and a slot-like through hole 2 is preferably molded from a material prepared by kneading magnetic material powders, such as ferrite powders, and a binder. Moreover, the supporting plate 3 is preferably made from a sintered porcelain material (such as highly pure alumina, steatite, and zirconia) or a metal material (such as tungsten and nichrome). These materials will not soften at the sintering temperature of the flattened tubular compact 1, or will generate only slight deformation to a negligible degree. In other words, the shape thereof can be maintained at the sintering temperature of the flattened tubular compact 1. For example, a material having a softening temperature higher than the sintering temperature of the flattened tubular compact 1 is selected. In addition, these materials are not significantly reactive with the ferrite in the flattened tubular compact 1.

The supporting plate 3 preferably has a substantially constant thickness and a substantially rectangular flat plate-like shape, with a width and a thickness allowing the supporting plate 2 to be inserted into the through hole 2 of the flattened tubular compact 1, and has a length that is sufficiently greater than that of the flattened tubular compact 1. In particular, the thickness of the supporting plate is preferably less than the shorter side dimension t of the through hole 2 of the magnetic core to be obtained by baking the compact 1, and is preferably greater than the diameter of the flat cable, or the like, to be inserted into the through hole 2.

Next, as shown in FIG. 2, the supporting plate 3 is inserted into the through hole 2 of the flattened tubular compact 1. A supporting plate 3 may be inserted through two or more flattened tubular compacts 1. The flattened tubular compact 1 is placed inside of a sintering container (not shown), preferably with highly pure alumina powder or zirconia powder spread therein, so that the longer side dimension of the supporting plate 3 is horizontally disposed.

Thereafter, the flattened tubular compact 1 is sintered in a sintering furnace with the axial direction thereof arranged horizontally. Even when the flattened tubular compact 1 softens during the sintering step so that the side wall portion at the upper side of the compact 1 sags toward the through hole 2 side, since the supporting plate 3 is inserted in the through hole 2, the short side dimension t of the through hole 2 cannot be less than the thickness dimension of the supporting plate 3. Accordingly, a magnetic core having a through hole with a desired short side dimension t is reliably achieved without deformation of the through hole 2. The supporting plate 3 is subsequently removed from the magnetic core produced by sintering the flattened tubular compact 1.

Figure 3:
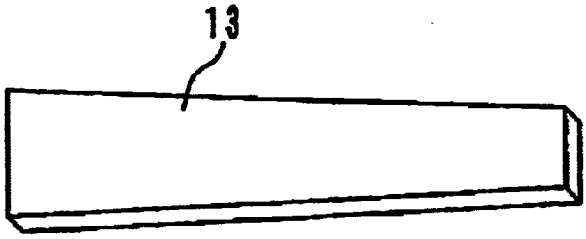
FIG. 3 is a perspective view showing a modified preferred embodiment of the supporting plate.

Moreover, in place of the supporting plate 3 having a constant thickness and a substantially rectangular flat plate-like shape shown in FIG. 1, a supporting plate 13 having a constant thickness and a width which continuously decreases from one end to the other end, that is, the tapered type shown in FIG. 3, can be used. The supporting plate 13 is constructed to be easily withdrawn from the magnetic core after the sintering step, and thus, it is not necessary to apply excessive force on the through hole of the magnetic core. This is effective in preventing chipping of the inner wall surface of the through hole so that production efficiency of the magnetic core can be improved.

Figure 4:
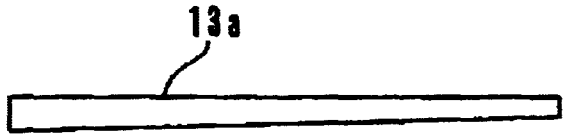
FIG. 4 is a plan view showing another modified preferred embodiment of the supporting plate.
Figure 5:
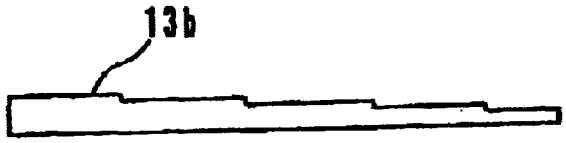
FIG. 5 is a plan view showing yet another modified preferred embodiment of the supporting plate.

Furthermore, a supporting plate 13*a* having a thickness which continuously decreases from one end to the other end as shown in FIG. 4, and a supporting plate 13*b* having a thickness which decreases from one end to the other end in a stepwise manner, as shown in FIG. 5, may also be used. The supporting plates 13*a* and 13*b* are constructed to be easily removed from the magnetic core after the sintering step, and thus the production efficiency of the magnetic core is greatly improved.

Figure 6:
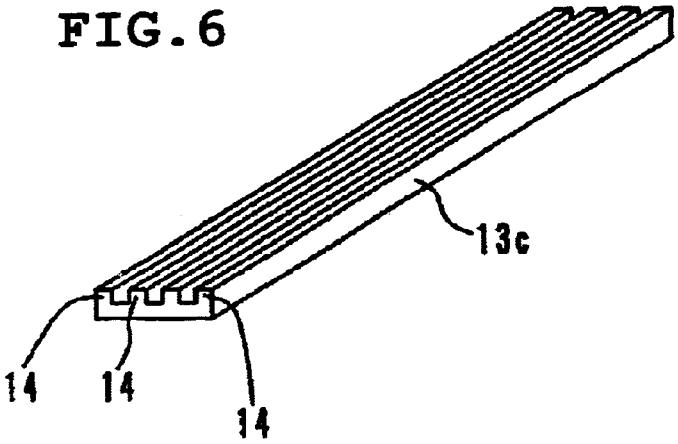
FIG. 6 is a perspective view showing still another modified preferred embodiment of the supporting plate.
Figure 7:
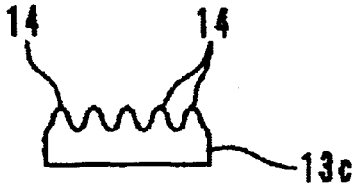
FIG. 7 is a side view of a supporting plate including projecting bars having a shape which is different from that of the projecting bars shown in FIG. 6.
Figure 8:
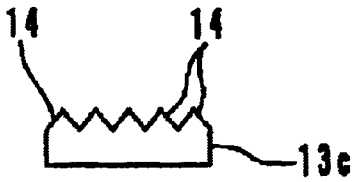
FIG. 8 is a side view of a supporting plate including projecting bars having a shape which is different from that of the projecting bars shown in FIG. 6.

Moreover, as shown in FIG. 6, a supporting plate 13*c* having a plurality of projecting bars 14 preferably with a substantially square shape in lateral cross-section, arranged to extend from one end to the other end on the upper surface thereof, may be used as well. The supporting plate 13*c* is inserted into the through hole 2 so that the direction of the projecting bars 14 and the direction of insertion into the flattened tubular compact 1 through the through hole 2 are substantially parallel to each other. The supporting plate 13*c* is constructed such that the contact area of the supporting plate 13*c* and the flattened tubular compact 1 is drastically reduced so that chemical reactions between the flattened tubular compact 1 and the supporting plate 13*c* are minimized. The lateral cross-sectional shape of the projecting bars 14 can be wavy or sawtooth, as shown in FIGS. 7 and 8.

Figure 9:
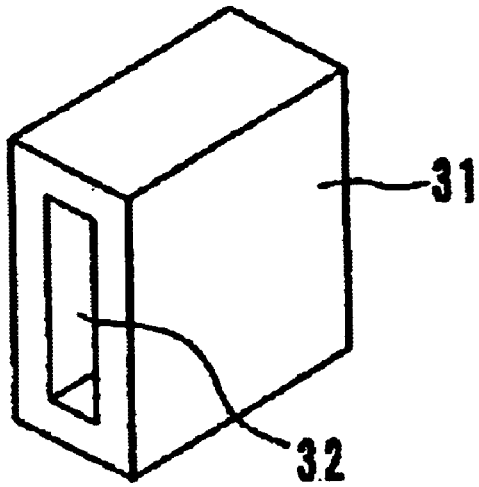
FIG. 9 is a perspective view showing a modified preferred embodiment of a magnetic core.
Figure 10:
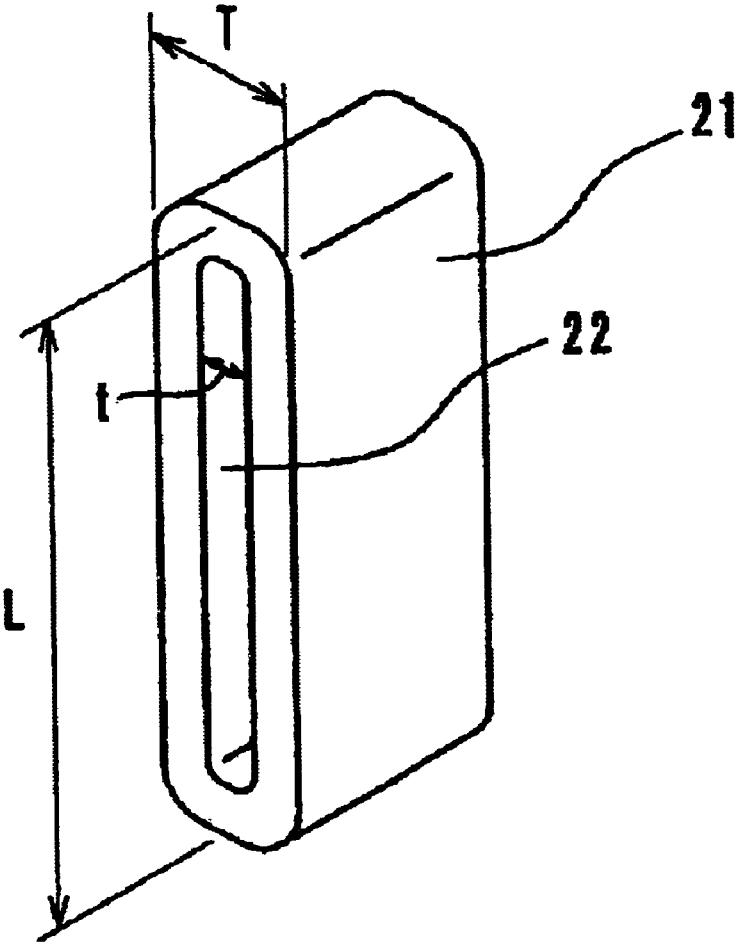
FIG. 10 PRIOR ART
FIG. 10 is a perspective view of a magnetic core.
Figure 11:
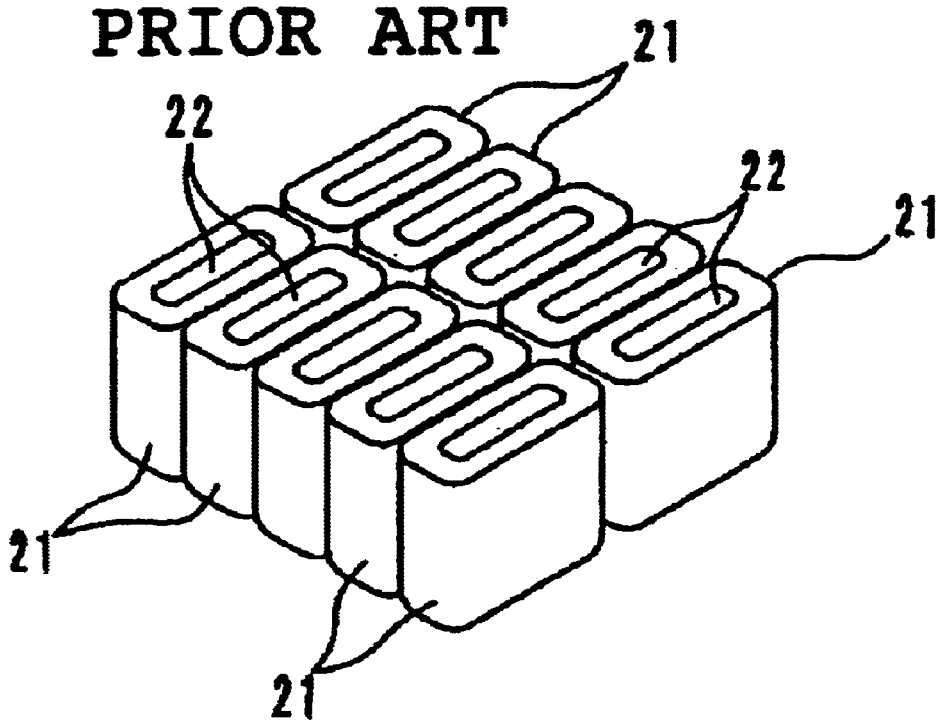
FIG. 11 PRIOR ART
FIG. 11 is a perspective view for illustrating a conventional method for sintering a magnetic core.
Figure 12:
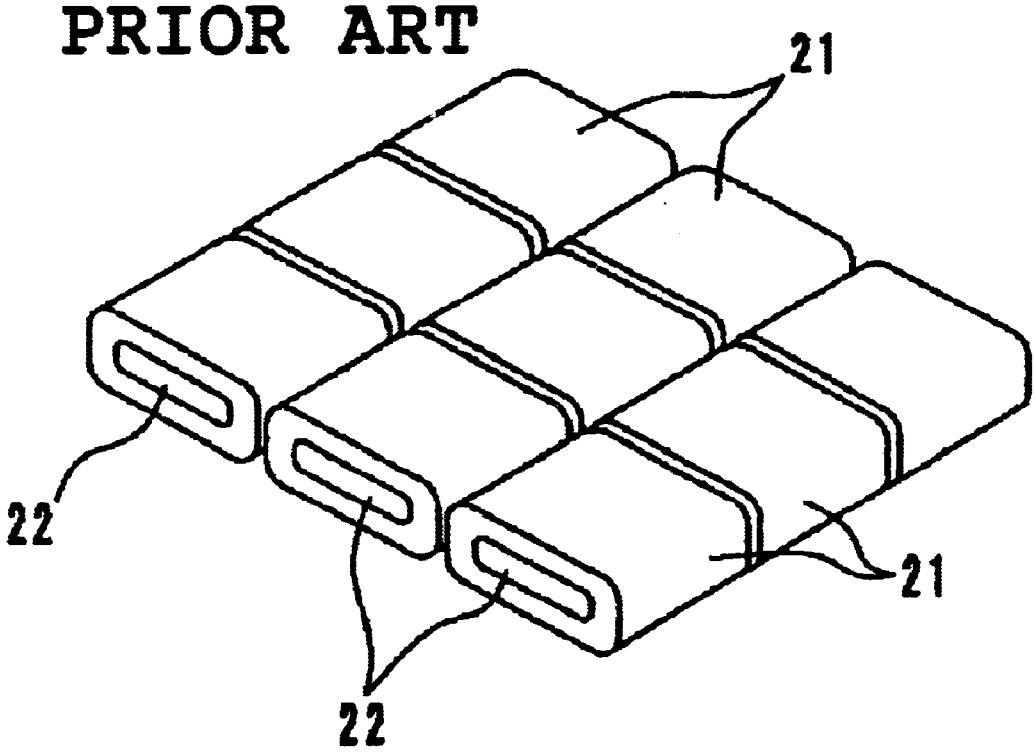
FIG. 12 PRIOR ART
FIG. 12 is a perspective view for illustrating another conventional method for sintering a magnetic core.

A method for sintering a magnetic core according to the present invention is not limited to the above-described preferred embodiments, but can be modified in various ways within the scope of the invention. In particular, the magnetic core may be a magnetic core 31 having a through hole 32 with a substantially rectangular lateral cross-section, as shown in FIG. 9.

An example of preferred embodiments of the present invention was prepared. More specifically, a flattened tubular compact having external dimensions of about 28 mm for the longer side dimension L, about 3 mm for the shorter side dimension T, and about 12 mm for the length, and a through hole 2 having dimensions of about 24 mm for the longer side dimension and about 0.7 mm for the shorter side dimension t (see FIG. 1) was prepared. Furthermore, a supporting plate 3 having external dimensions of about 22 mm in width, about 60 mm in length, and about 0.55 mm in thickness (see FIG. 1) was prepared, and a supporting plate 13*a* having external dimensions of about 22 mm in width, about 60 mm in length, about 0.56 mm in thickness at one end and about 0.55 mm in thickness at the other end (see FIG. 4) was prepared. Furthermore, the flattened tubular compact 1 was placed in a sintering container having highly pure alumina powder spread therein with the supporting plates 3 and 13*a* inserted in the through hole 2 thereof for sintering at 1,100° C.

Among 1,000 sample pieces sintered according to this process, no magnetic core was found to have a through hole shorter side dimension t of about 0.55 mm or less. Furthermore, none of the cores were bent, deformed, chipped, or otherwise damaged, which would potentially cause problems in practical use. That is, there were no problems in inserting the flat cables through the through holes of the magnetic cores. Furthermore, when the supporting plates 13*a* were used, chipping of the inner wall surface corner portions of the through holes was reduced to one-half or less compared to the case in which the supporting plates 3 were used.

As is apparent from the explanation above, according to preferred embodiments of the present invention, since a flattened tubular compact is sintered in a state in which a supporting plate is inserted through the through hole thereof, even when the flattened tubular compact softens during baking, raising the possibility of "sagging", the shorter side dimension of the through hole of the magnetic core cannot be less than the thickness dimension of the supporting plate. Accordingly, the risk of deformation of or damage to the through hole, which would be a problem in practical use, is avoided, and a magnetic core having a through hole having a desired shorter side dimension is achieved.

Moreover, since the supporting plate is tapered in the direction of insertion into the through hole of the flattened tubular compact, the operation of removing the supporting plate from the magnetic core is greatly facilitated without the need to apply excessive force to the through hole of the magnetic core. Accordingly, this is effective for prevention of chipping of the inner wall surface of the through hole, and production efficiency of the magnetic core is thereby greatly improved.

The present invention has been described in detail with particular reference to preferred embodiments thereof, but it should be understood that variations and modifications can be made within the spirit and scope of the present invention.

What is claimed is:

1. A method for sintering a magnetic core, comprising the steps of:

providing a flattened tubular compact made from a magnetic material and having a through hole, said flattened tubular compact having a longer side and a shorter side, and having external dimensions such that a length of the longer side dimension is greater than a length of the shorter side dimension;

providing a supporting plate which is constructed such that the supporting plate maintains the supporting plate's shape at a sintering temperature of the flattened tubular compact, said supporting plate having a plate-shaped configuration, and a thickness of said supporting plate is equal to or greater than a thickness of a flat cable to be inserted into the through hole;

inserting the supporting plate through the through hole of the flattened tubular compact; and sintering the flattened tubular compact while the supporting plate is located in the through hole of the flattened tubular compact, such that an axial direction of the flattened tubular compact is arranged horizontally during sintering.

2. The method according to claim 1, wherein the supporting plate is made of a sintered ceramic material.

3. The method according to claim 1, wherein the supporting plate is made of a baked porcelain material.

4. The method according to claim 1, wherein the supporting plate is made of a metal material.

5. The method according to claim 1, wherein the supporting plate is arranged in the through hole of the flattened tubular compact such that the supporting plate prevents a shorter side dimension of the through hole of the magnetic core from being less than the thickness of the supporting plate.

6. The method according to claim 1, wherein the supporting plate is tapered in the direction of insertion into the through hole of the flattened tubular compact.

7. The method according to claim 1, wherein the supporting plate has a length that is sufficiently longer than that of the flattened tubular compact.

8. The method according to claim 1, further comprising the step of placing the tubular compact inside of a sintering container having highly pure alumina powder spread therein so that the axial direction of the compact is horizontally disposed just before the step of sintering.

9. The method according to claim 1, wherein the supporting plate has a substantially constant thickness.

10. The method according to claim 1, wherein the supporting plate has a substantially rectangular flat plate shape.

11. The method according to claim 1, wherein the inserting step includes inserting the supporting plate the through holes of at least two of the flattened tubular compacts.

12. The method according to claim 1, wherein the supporting plate has a thickness which continuously decreases from a first end to a second end of the supporting plate.

13. The method according to claim 1, wherein the supporting plate has a thickness which decreases from a first end to a second end of the supporting plate in a stepwise manner.

14. The method according to claim 1, wherein the supporting plate includes a plurality of projecting bars.

15. The method according to claim 14, wherein the projecting bars have a substantially square shape in lateral cross-section.

16. The method according to claim 15, wherein the supporting plate is inserted into the through hole so that the direction of the projecting bars and the direction of insertion into the flattened tubular compact through the through hole are substantially parallel to each other.

17. The method according to claim 14, wherein the lateral cross-sectional shape of the projecting bars has a wavy configuration.

18. The method according to claim 14, wherein the lateral cross-sectional shape of the projecting bars has a sawtooth configuration.

19. A method for sintering a magnetic core, comprising the steps of:

providing a flattened tubular compact having a through hole, said flattened tubular compact having a longer side and a shorter side, and having external dimensions such that a length of the longer side dimension is greater than a length of the shorter side dimension;

providing a supporting plate having a plate-shaped configuration, a thickness of said supporting plate is equal to or greater than a thickness of a flat cable to be inserted into the through hole;

inserting the supporting plate through the through hole of the flattened tubular compact; and sintering the flattened tubular compact while the supporting plate is located in the through hole of the flattened tubular plate, such that an axial direction of the flattened tubular compact is arranged horizontally during sintering.

20. The method according to claim 19, wherein the flattened tubular compact is made from a magnetic material and having a through hole and the supporting plate is constructed to maintain the supporting plate's shape at a sintering temperature of the flattened tubular compact.

* * * * *